US006832640B2

(12) United States Patent
Caprara et al.

(10) Patent No.: US 6,832,640 B2
(45) Date of Patent: Dec. 21, 2004

(54) DEVICE FOR GRIPPING AND HANDLING BOTTLES IN A LABELING MACHINE AND METHOD OF BOTTLE FILLING/ PRESSURISING

(75) Inventors: Alessandro Caprara, Isola Della Scala (IT); Emanuele Mazzotta, Lunetta (IT)

(73) Assignee: SIG Alfa S.p.A., Mantova (IT)

( * ) Notice: Subject to any disclaimer, the term of this patent is extended or adjusted under 35 U.S.C. 154(b) by 105 days.

(21) Appl. No.: 10/125,682

(22) Filed: Apr. 18, 2002

(65) Prior Publication Data

US 2002/0166640 A1 Nov. 14, 2002

(30) Foreign Application Priority Data

Apr. 20, 2001 (IT) ..... MI2001A0838

(51) Int. Cl.[7] ..... B65C 9/02; B65C 9/04

(52) U.S. Cl. ..... 156/556; 156/556; 156/567; 156/DIG. 25; 156/DIG. 26; 156/448

(58) Field of Search ..... 156/556, 566, 156/567, DIG. 25, DIG. 26, 447, 448, 458; 141/25, 129; 198/379

(56) References Cited

U.S. PATENT DOCUMENTS 3,802,942 A * 4/1974 Amberg et al. ..... 156/443
4,721,138 A * 1/1988 Simonazzi ..... 141/150
5,219,405 A * 6/1993 Weiss ..... 141/149
5,290,388 A * 3/1994 Zepf ..... 156/447
5,307,761 A * 5/1994 Berger et al. ..... 119/165
5,650,037 A * 7/1997 Larson ..... 156/540

FOREIGN PATENT DOCUMENTS

DE 4125579 A1 * 2/1993 ..... B65C/9/02

* cited by examiner

*Primary Examiner*—Sue A. Purvis

(57) ABSTRACT

The device (1) for gripping and handling bottles (3) in a labelling machine comprises at least one body carrying a gripping member (2) of the neck of a bottle (3), control means (4) in rotation of said gripping member (2) and a centering member (5) of the bottle (3) with respect to said gripping member (2).

In the method of bottle filling/pressurising a stem (9) of a gripping and handling device (1) for bottles (3), provided with a passage (14) for the filling/pressurising gas for bottles (3), associates with an opening of the bottle (3), after that a tubular member (7) containing the stem (9) translates with respect to the stem (9) and opens an on-off valve (15), thereby causing the filling/pressurising of the bottle (3).

17 Claims, 4 Drawing Sheets

DEVICE FOR GRIPPING AND HANDLING BOTTLES IN A LABELING MACHINE AND METHOD OF BOTTLE FILLING/ PRESSURISING

FIELD OF THE INVENTION

The present invention relates to a device for gripping and handling bottles in a labelling machine, and to a method of filling and pressurizing bottles.

In particular, the device according to the invention can be used on, machines for labelling plastic bottles.

BACKGROUND OF THE INVENTION

Current labelling machines have a carrousel structure and are provided with a plurality of devices for gripping and handling bottles along their periphery.

Each device comprises a disk, associated through a guiding roller with a mechanical cam, and a member for centering the container relative to the disk.

The mechanical cam places the disks and the bottles resting on them in rotation so that the bottles are suitably brought to the labelling units that apply the labels.

However, such traditional devices have several disadvantages due to the fact that the system is not very flexible since the drives are mechanical.

In fact, when the bottle or the type of label being applied are changed, the device settings must be changed accordingly, so as to adapt them to the particular production or type of bottle being produced.

This implies that in the traditional devices, the mechanical cams arranged around the entire carrousel machine need to be replaced with different and suitably shaped cams.

Such operation causes even very long periods of inactivity.

Moreover, it is often necessary to replace also the devices feeding the bottles to the machine, such as for example screw conveyors and/or radial arms, thereby further increasing the periods of inactivity of the machine.

Moreover, the lower overall dimensions of traditional devices are always very large, since both the disks supporting the bottles from the base, and the cam, are arranged in the lower portion of the machine.

This hinders accessibility to the component parts of the labelling machine, as well as their cleaning.

OBJECTS OF THE INVENTION

An object of the present invention is to eliminate the above-mentioned prior-art disadvantages by providing a device for gripping and handling bottles in a labelling machine in a highly flexible operation.

Another object of the invention is to provide a device which should allow changing the settings to apply different labels or on different types of bottles, in a very, quick and easy manner, so as to obtain very limited dead times and ensure a very high productivity.

Another object of the invention is to provide a device which should not require replacing he mechanical cams with different cams and/or replacing the devices for feeding the containers to the machine, such as screw conveyors and/or radial arms.

A further object of the invention is to provide a device which exhibits limited overall dimensions at its lower portion, so as to ensure good accessibility to the component parts of the machine and considerably facilitate their cleaning.

Last but not least, yet another object of the invention is to provide a method of bottle filling and pressurizing.

SUMMARY OF THE INVENTION

These and other objects are achieved by a device for gripping and handling bottles in a labelling machine, which comprises at least one body carrying a member for gripping a bottleneck, control means in rotation of said gripping member, and a member for centering said bottle relative to said gripping member.

The invention also relates to a method of bottle filling and pressurizing, wherein a stem of a bottle gripping and handling device, provided with a passage for the bottle filling and pressurizing gap, associates with an opening of the bottle, after that a tubular member containing the stem translates with respect to the stem and opens an on-off valve, thereby causing the bottle filling and pressurizing.

Advantageously, in the device according to the invention the control means actuates in rotation only the gripping member, and the centering member through the bottle. The other members, on the other hand, do not rotate.

The device can be used with several types of bottles having different shape and size, since all bottles exhibit similarities in their upper portion, in the proximity of the mouth, whereas they may exhibit even considerable differences at the bottom.

BRIEF DESCRIPTION OF THE DRAWING

Further features and advantages of the invention will appear more clearly from the description of a preferred but not exclusive embodiment of the bottle gripping and handling device in a labelling machine according to the finding, illustrated by way of a non-limiting example in the attached drawing. In such drawing.

SPECIFIC DESCRIPTION

Figure 1:
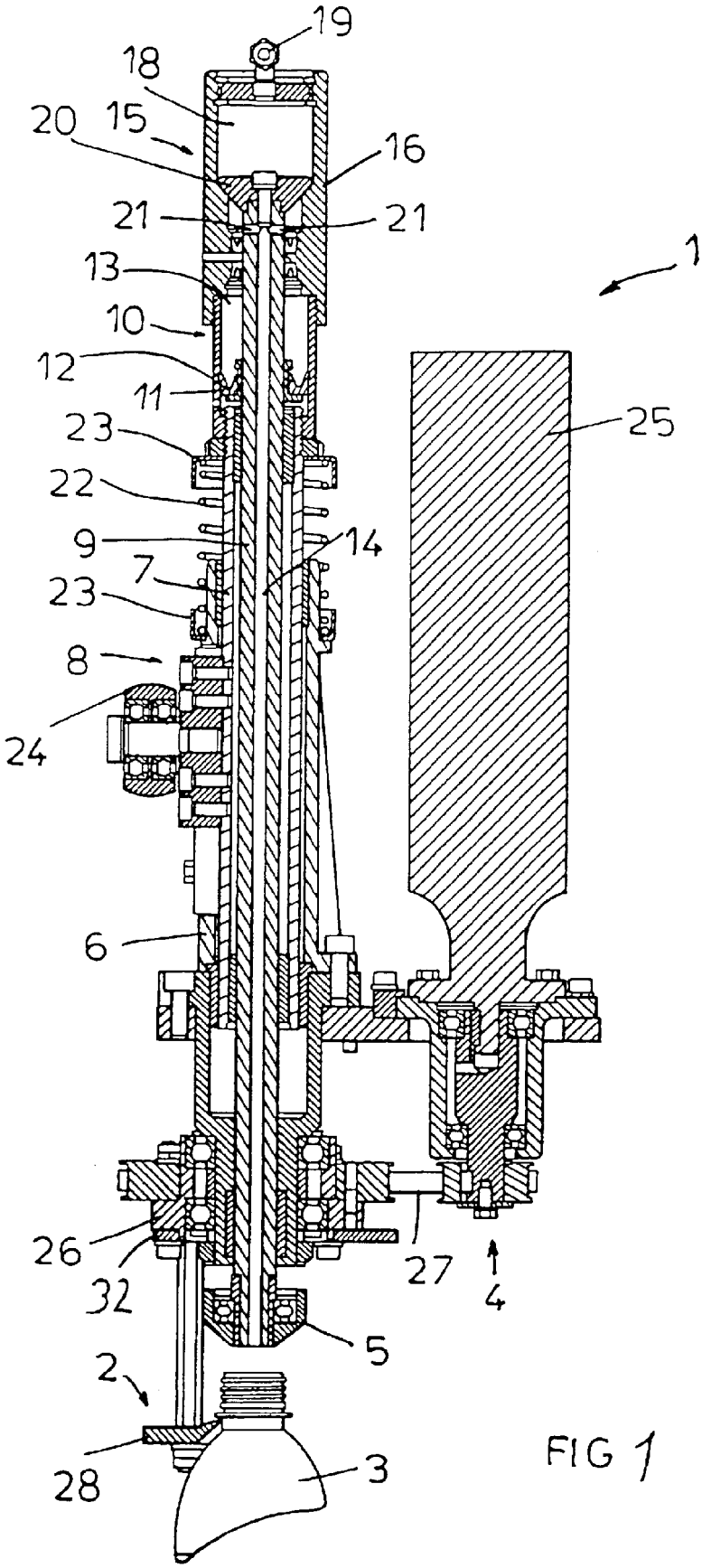
FIG. 1 is a side elevation section of the device according to the invention.
Figure 2:
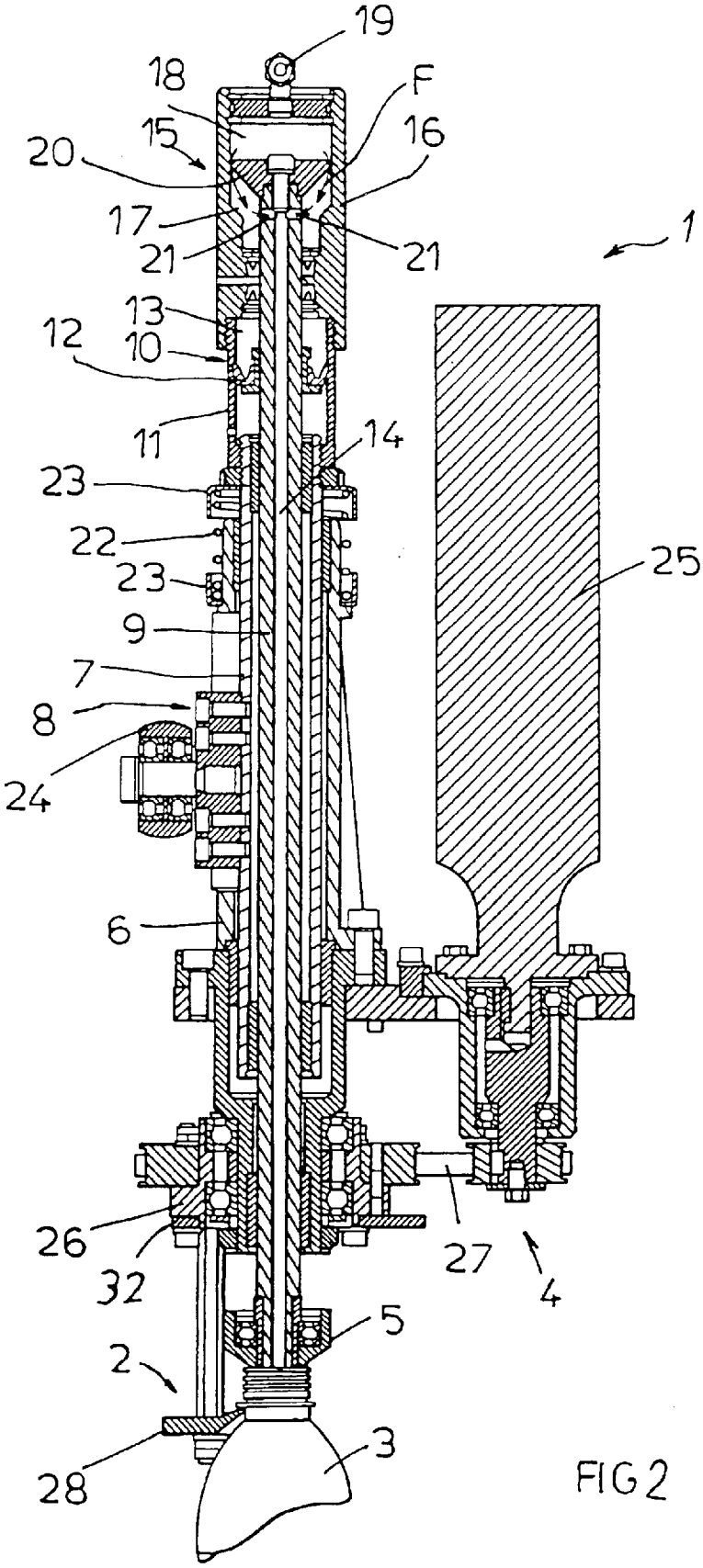
FIG. 2 is a side elevation section of the device of the invention in a different operating configuration.

The drawing shows a bottle gripping and handling device in a labelling machine generally indicated with reference numeral 1.

Device 1 comprises a body carrying a member 2 for gripping the neck of a bottle 3.

Bottles 3 are preferably fed to the device 1 by air and radial-type conveyors supporting them from the necks (enlarged external edge arranged at the thread).

In this way, the gripping member 2 can grip the bottles at the lower portion of the neck, in a simple way and without any risk of overturning them.

Moreover, device 1 also comprises control means 4 that causes rotation of the gripping member 2 and a centering member 5 for bottle 3 relative to the gripping member 2.

The gripping member 2 places bottle 3 in rotation and, in turn, the bottle 3 rotates the centering member 5; in this way, the centering member 5 is placed in rotation by the same bottle 3.

The body of device 1 comprises an outer tubular member 6, which supports the gripping member 2 for rotation and receives an intermediate tubular member 7 provided with a guiding member 8, is slidingly connected.

A stem 9, carrying the centering member 5 at one end, slidingly received in the intermediate tubular member 7.

Moreover, first elastic means 10 is arranged between the intermediate tublar member 7 and stem 9.

The first elastic means 10 comprises an elastic gas member which in the example shown, is realized by a tubular body 11 coaxially cross by stem 9 and delimited by two sealing gaskets.

In particular, the sealing gasket 12 that delimits the lower portion of the tubular member 11 (that is, towards the centering member 5) is contained in a seat of stem 9 and is thereby integral with stem 9.

In this way, a compensation chamber 13 containing compressible gas (for example, air) is formed in the tubular body 11, and the pressure in such compensation chamber presses the centering member 5 against bottle 3.

Stem 9 and the centering member 5 have a passage 14 for introducing a gas under pressure into bottles 3.

At the end of stem 9 opposite that carrying the centering member 5 there is a gas on-off valve 15.

Such on-off valve 15 comprises a body 16 provided with a shoulder 17 and which forms a pressurization chamber 18 connected to a gas input through a union 19.

The gas input (not shown) is provided with filters adapted for sterilizing the gas; in this way, the portions of device 1 that come into contact with the gas are also sterile.

Moreover, device 1 also comprises equipment (not shown) for conveying sanitizing fluid to the same union 19, for sterilizing the device circuit.

A washer 20 connected to the end of stem 9 slides into the pressurization chamber.

Washer 20 can abut against shoulder 17 to close valve 15.

Moreover, stem 9 has openings 21 for connecting passage 14 with the pressurization chamber 18.

Such passages 21 are obtained in the proximity of washer 20 at the side of stem 9 facing the centering member 5.

Moreover, device 1 comprises second elastic means 22, consisting of a spiral spring arranged between two seats 23, one integral with the outside tubular member 6 and the other integral with the intermediate tubular member 7.

Such spring 22 opposes the vertical motion of the guiding member 8.

The guiding member 8 comprises a roller 24 slidingly associated with a cam (not shown).

The control means 4 comprises an electric motor 25 preferably of the brushless type or other servomotor, controlled by a electronic device.

Motor 25 is connected to the outside tubular member 6; moreover, as shown, motor 25 and the outside tubular member 6 have substantially parallel axes.

In this way, a very compact structure is obtained.

Moreover, the control means 4 comprises a support 26 integrally carrying the gripping member 2, turnably connected to the outside tubular member 6.

Support 26 is connected to motor 25 by flexible connection means 27, such as a belt.

In a preferred embodiment, the gripping member 2 comprises a fork 20 adapted for gripping a protruding edge, or neck, of bottles 3.

Figure 3:
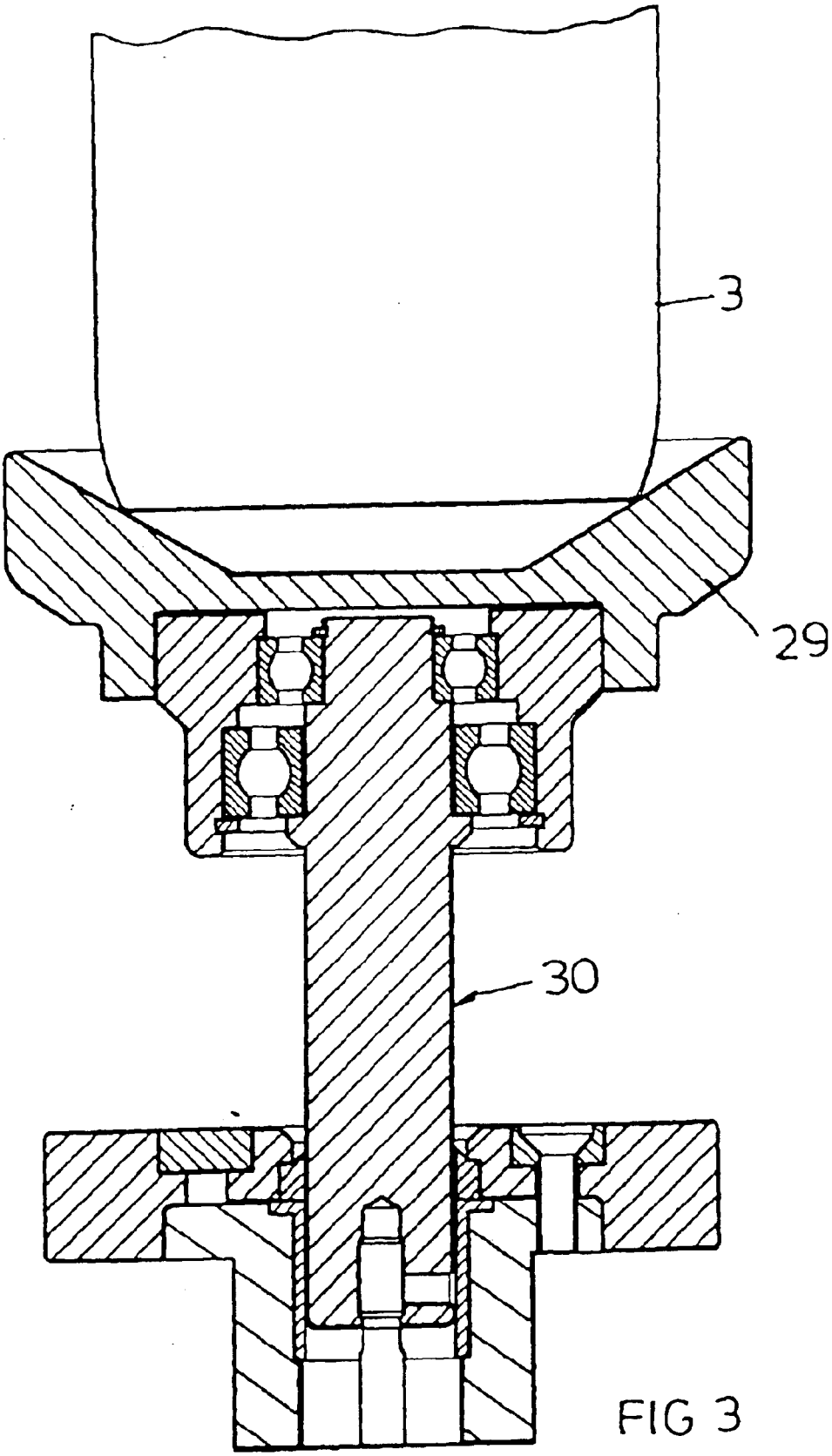
FIG. 3 is an enlarged longitudinal section of a conical centering member associated to a bottle.

Moreover, in a different embodiment device 1 also has a conical centering member 29 (FIG. 3) turnably neutral, to which bottle 3 is associated at a lower portion.

The conical centering member 29 prevents the misalignment of bottle 3 with the axis of stem 9.

In a preferred embodiment of the device, the conical centering member 29 is connected to a support 30 having at least one portion that can substantially vertically translate based on the size of bottle 3.

Support 30 starts after bottle 3 has come into contact with the centering member 5.

Thus, in practice, a first centering is carried out on the upper portion of the bottle, which also ensures the contact between bottle and device, and then a lower centering is carried out as well.

In the example shown, the conical centering member is connected to a stem of a vertically movable gas or hydraulic cylinder.

Moreover, in a preferred embodiment, device 1 comprises a synchronization member 32, that is a safety element and allows synchronizing the motion of the gripping means 2 with respect to the radial-type conveyors for both feeding and releasing the bottles.

In practice, upon assembly, it is not necessary to synchronize the gripping meal with the radial-type conveyors since such operation is carried out by the synchronization member 32 when the labelling machine is actuated (for example, very slowly and without bottles).

Moreover, during the operation of the labelling machine, the synchronization member 32 prevents device 1 from losing synchronization with the radial-type conveyors.

Figure 4:
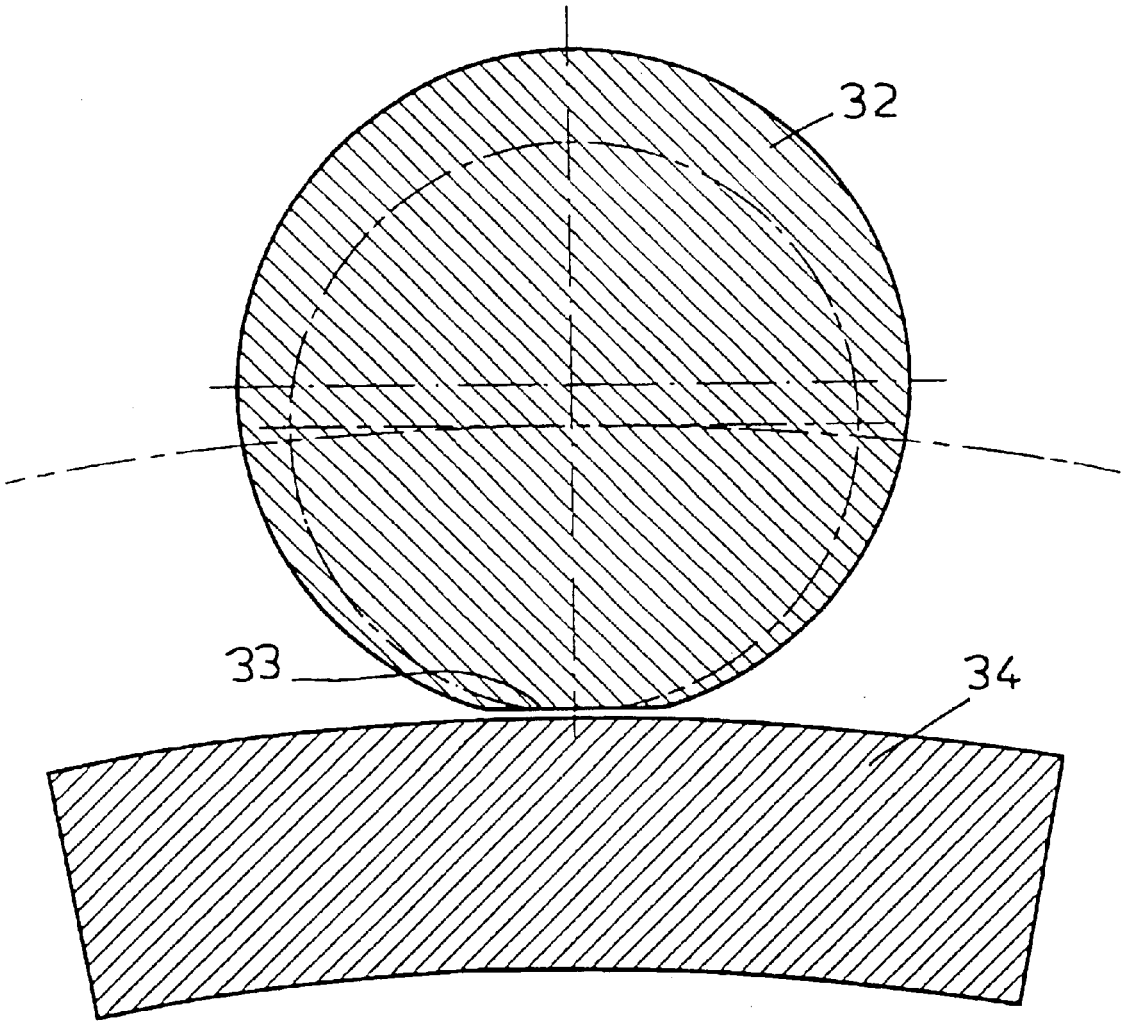
FIG. 4 is an enlarged plan section of a member for synchronizing the device according to the invention.

The synchronization 32 comprises a circular plate provided with a flattened portion 33 (FIG. 4).

Plate 32 is mounted eccentrically on support 26 and has flattened portion 33 associatable with cams 34.

Cams 34 are supported by radial-type conveyor for feeding the bottles and the other is supported by the radial-type discharge conveyor.

As it can be seen in the figures, when the flattened portion 33 is not associated with cam 34, plate 32 rotates carrying portion 33 at plate 34 and synchronizing the gripping means 2 with the radial-type conveyors.

The operation of the device for gripping and handling bottles in a labelling machine according to the invention is clear from what has been described and illustrated. In particular, it is substantially as follows.

Air conveyors carry the bottles and the radial-type conveyers bring the bottles to the gripping member 2, which grips them.

Then, the guiding member 8 (guided by a mechanical cam, not shown) makes the intermediate tubular member 7 translate, along with stem 9 (due to the pressure in the compensation chamber 13).

Stem 9 carries the centering member 5 onto the opening of bottle 3 and locks up; on the other hand, since the intermediate tubular member is pushed by the guiding member 8, it further translates and slides with respect to stem 9, making the volume of the compensation chamber 13 decrease.

The centering member 5 kept against bottle 3 by the pressure existing in chamber 13 and, at the same time, bottle 3 is supported by the gripping member 2 at the neck.

Bottle 3 thus remains locked and centered between members 2 and 5.

The translation of the intermediate tubular member 7 when stem 9 is fixed causes valve 15 to open.

In fact, the washer slide in the pressurization chamber 18 thereby moving away from shoulder 27 and allowing the gas flow, as indicated by arrows F.

On the other hand, when bottle 3 is not present, stem 9 continues to go down along with the tubular member 7 and valve 15 does not open.

The gas is thus introduced through the openings 21 into passage 14 and it is introduced into bottle 3, making it stiff and allowing labelling.

Motor 25 places support 26 in rotation, and then, the gripping member 2 according to settings (for example, via software) on the control circuit of the same motor 25.

Device 1 is very flexible since the bottle rotation is controlled by motor 25 and can thus be changed in a very simple and quick way.

On the other hand, the guiding member 8, that acts on a cam, does not restrict the device flexibility since it only controls the translation of the inside tubular member 7 and of stem 9.

In the practice, the guiding member 8 controls the gripping and release steps of bottle 3 that are common for all bottle formats.

Thus, guide 8 can be used without the need of replacing the cam for several bottle shapes and sizes.

The present invention also refers to a method of bottle filling and pressurizing, wherein a stem of device 1, provided with passage 14 for the gas for filling and pressurizing bottle 3, is associated to an opening of bottle 3.

Afterwards, the intermediate tubular member 7 containing stem 9 translates with respect to stem 9 and opens an on-off valve 15, thereby filling and pressurizing bottle 3.

In the practice, it has been found that the device for gripping and handling bottles in a labelling machine according to the invention is particularly advantageous since it is very flexible.

The device for gripping and handling bottles in a labelling machine thus conceived can be subject to several changes and variants, all falling within the scope of the inventive idea; moreover, all details can be replaced with other technically equivalent ones.

In the practice, the materials used, as well as the sizes, can be of any type according to the requirements and to the prior art.

What is claimed is:

1. A device for gripping and handling bottles in a labelling machine comprising:

at least one body carrying a gripping member adapted to grip a neck of a bottle;

control means operatively connected to said gripping member for rotating said gripping member;

a top centering member engageable with the bottle for centering the bottle with respect to said gripping member, said top centering member being placed in rotation by said bottle.

2. The device defined in claim 1 wherein said body comprises an outer tubular member, that rotatably supports said gripping member, an intermediate tubular member slidably received in said outer tubular member and provided with a guiding member, a stem carrying said top centering member, and a first elastic means surrounding said stem.

3. The device defined in claim 2 wherein said first elastic means comprises an elastic gas member.

4. The device defined in claim 3 wherein said elastic gas member comprises a tubular body traversed by said stem and delimited by two sealing gaskets one of said sealing gaskets delimiting a lower portion of said tubular body is being supported by said stem.

5. The device defined in claim 2 wherein said stem and said centering member have a passage for introducing gas under pressure into said bottle.

6. The device defined in claim 5 wherein a gas on-off valve is associated with an end of said stem.

7. The device defined in claim 6 wherein said on-off valve comprises a body provided with an inside shoulder that forms a pressurization chamber inside which there slides a washer connected to an end of said stem, said washer being adapted for abutting against said shoulder for closing said on-off valve, and said stem having openings connecting said passage with said pressurization chamber 18).

8. The device defined in claim 3 which comprises second elastic means arranged between said outer tubular member and said intermediate tubular member.

9. The device defined in claim 3 wherein said guiding member comprises a roller slidingly associated with a cam.

10. The device defined in claim 2 wherein said control means comprises an electric motor controlled by an electronic device.

11. The device defined in claim 10 wherein said motor is connected to said outer tubular member, and said motor and said outer tubular member have substantially parallel axes.

12. The device defined in claim 11 wherein said control means comprises a support, that integrally carries said gripping member rotatably connected to said outer tubular member, said support being connected said motor through flexible connection means.

13. The device defined in claim 2 wherein said gripping member comprises a fork adapted for gripping a protruding edge of a bottle.

14. The device defined in claim 2 which comprises a bottom centering member turnably neutral, to which said bottles can be associated at a lower portion.

15. The device defined in claim 14 wherein said bottom centering member is connected to a support having at least one portion that can be substantially vertically translated.

16. The device defined in claim 2 which comprises a synchronization member for synchronizing the motion of said gripping members with respect to radial-type conveyors for feeding and/or releasing the bottles.

17. The device defined in claim 16 wherein said synchronization member comprises a circular plate provided with a flattened portion, wherein said flattened portion can be associated to a cam 34 supported by a said radial-type conveyor for feeding and/or releasing said bottles.

* * * * *